United States Patent [19]

Spring

[11] Patent Number: 5,014,478

[45] Date of Patent: May 14, 1991

[54] PANELS AND PANEL INTERLOCKING MEANS

[75] Inventor: Richard C. Spring, Tampa, Fla.

[73] Assignee: Insulated Panel Systems, Inc., Oldsmar, Fla.

[21] Appl. No.: 411,356

[22] Filed: Sep. 22, 1989

[51] Int. Cl.[5] ..... E04B 5/00

[52] U.S. Cl. ..... 52/281; 52/586; 52/271; 52/464

[58] Field of Search ..... 52/281, 586, 271, 461, 52/464, 466, 309.11, 583, 285, 282

[56] References Cited

U.S. PATENT DOCUMENTS

| | | | |
|---|---|---|---|
| 3,160,249 | 12/1964 | Paulecka | 52/586 |
| 3,512,819 | 5/1970 | Morgan et al. | 52/309.1 X |
| 3,592,289 | 7/1971 | Aysta | 52/656 X |
| 3,640,039 | 2/1972 | McKee et al. | 52/586 X |
| 3,685,222 | 8/1972 | Curtess | 52/586 X |
| 3,729,889 | 5/1973 | Baruzzini | 52/264 |
| 3,831,339 | 8/1974 | Piralli | 52/586 |
| 4,730,428 | 3/1988 | Head et al. | 52/586 X |

*Primary Examiner*—David A. Scherbel
*Assistant Examiner*—Creighton Smith
*Attorney, Agent, or Firm*—Joseph C. Mason; Ronald E. Smith

[57] ABSTRACT

Track members of specific configuration are embedded in the edges of flat panel members. Extrusion members of specific configuration are employed to interlock the track members to one another in differing configurations. Each track member defines a cavity and in a first embodiment, two cavities are brought into abutting relation to one another to form a collective cavity into which a first embodiment of the extrusion member slidably fits. When so interlocked, the panels collectively form a wall or other surface. Additional embodiments enable the panels to be disposed at right angles to one another, to form "+" sign shaped intersections, radial arrays, and the like.

7 Claims, 3 Drawing Sheets

PANELS AND PANEL INTERLOCKING MEANS

TECHNICAL FIELD

This invention relates, generally, to panels having utility as display surfaces, walls, and the like. It also relates to extrusions having utility in interlocking a plurality of panels along their edges.

BACKGROUND ART

Small, light-in-weight panels can be interlocked with one another to form large, modular structures such as divider walls, display panels for use at trade shows, and a myriad of other structures.

Accordingly, inventors have developed the panel art by providing structurally sound, light-in-weight panels that interlock along their edges to facilitate the assembly and disassembly of modular structures.

Examples of panel constructions and means for interlocking panels of like or similar construction are shown in U.S. Pat. Nos. 3,512,819 to Morgan et al., 4,730,428 to Head et al., 3,831,339 to Piralli, 3,592,289 to Aysta and 3,729,889 to Barazzini et el. Also of interest is U.K. patent No. 7878 (1886), French patents 889,320 (1943) and 1,400,453 (1965), Swiss patents 280,926 (1952) and 562,095 (1975), German patents 866,844 and 937,614 (1956), Canadian patent 764,645 (1967), and Italian patent 719,512 (1966).

A major shortcoming of the prior art devices is the difficulty encountered in separating the panels once they are assembled together. The art of easy to assemble and easy to take apart panels has not heretofore reached a high state of development.

The art can be divided into two main classifications: panels having specifically configured edges that interlock with mirror image edges of their mating panels, and those constructions where the panel edges do not interlock directly with adjacent panel edges but where a separate interlocking piece is employed to join two panels together.

Although both major classifications of the art are well developed, a need is still extant for a panel system that is more cost effective to manufacture than the systems heretofore known. Moreover, a need remains for panels that are easier to assemble into modular arrays than the panels of the prior art. Perhaps more importantly, a need exists for a panel system that is very easy to disassemble. Moreover, there remains a need for a panel system that facilitates the ready assembly of panel members and not only edge-to-edge relation to one another, but in three way ("T"), four way ("+"), orthogonal ("L") and other intersections as well.

DISCLOSURE OF INVENTION

The present invention falls into the second-mentioned classification discussed above, i.e., the panel members of this invention are not directly coupled to one another. Instead, the edges of each panel have embedded therein a track member that is specifically configured to slidably receive a first part of an extrusion member. A second part of each extrusion member is slidably received within a track embedded within the edge of an adjacent panel. Thus, although the adjacent track members do abut one another, the panel edges are not directly interlocked.

The track members that are embedded in the edges of each panel may be of vinyl or aluminum construction, or may be formed of other suitable material. In a preferred embodiment, each track member has a bottom wall, laterally spaced apart side walls integral thereto that project orthogonally therefrom in parallel relation to one another, inwardly directed top walls integral to the top of each side wall and orthogonally disposed thereto, and outwardly directed top walls, coplanar and integral with the inwardly directed top walls, that extend outwardly to the front and back surfaces of the panel. An anchoring means projects inwardly from the bottom wall to hold the track to the panel edge.

The panel body or core is formed of a suitable material such as urethane foam. Although the panels may take substantially any predetermined geometrical configuration, square and rectangular configurations are the most economical shapes to manufacture. To make a square panel, four track members of equal length are arranged in a square and positioned in sandwiched relation between a pair of massive, flat-faced fixtures that are spaced apart from one another by the width of the track members. An aperture means or charging opening is formed in the bottom wall of one of the track members and urethane foam, in a semi-liquid state, is charged thereinto. The massive fixtures retain the expanding foam as it cures so that when the foam has cured, the fixtures may be removed and a panel having a flat front and back square surface is achieved. Importantly, the track members will be firmly embedded in the edges of the panel. Rectangular panels are formed in a similar way.

The bottom, side and inwardly converging top walls of the track member collectively form a cavity means having a narrow opening between the innermost ends of the confronting inwardly directed top walls. Thus, when two panels are disposed in edge-to-edge relation to one another, the cavity openings of each track member will align with one another. Since the narrow openings of each cavity open into larger cavities, an interlocking member having enlarged opposite ends interconnected by a smaller medial part will slidably interlock the abutting panel edges.

In a first embodiment of interlocking members, all of which may be extrusions, i.e., formed by extrusion, the member has an "H"-shaped configuration. The truncate cross bar of the "H" is received by the abutting narrow cavity openings, and the elongate spaced apart parts of the "H" are received within the main cavity defined by the bottom, side and inwardly converging top walls of the track member.

In a second embodiment of interlocking members, a "T" shaped branch of the interconnecting member is added to the basic "H"-shaped member. Specifically, the base of the "T" is integral to the mid-point of the truncate cross bar of the "H" and extends therefrom in parallelism to the elongate parts of the "H." The cross bar of the "T" is slidably received within the cavity means of a track of a third panel disposed orthogonally to the two interlocked edge-to-edge panels.

A third embodiment adds a second "T"-shaped branch that is the mirror image of the first branch so that a fourth panel can be added to produce an arrangement of panels having a "+" shape when seen in plan view.

In a fourth embodiment, an elongate extrusion member having a ninety degree bend formed therein has an outwardly extending "half H" integral to a first part thereof and an outwardly extending "half H" integral to the second part thereof. This extrusion attaches together two panels to form a ninety degree corner.

A fifth embodiment of the extrusion is very similar to the fourth embodiment thereof, the difference being that the "half H" integral to the second part extends inwardly. The extrusion still positions two panels in orthogonal relation to one another, but with increased stability as will become more clear when the drawings are examined in connection with the detailed description that follows.

The primary object of this invention is to provide sturdy, light-in-weight panel members interlockable together by extrusion members of elegant construction.

The invention accordingly comprises the features of construction, combination of elements and arrangement of parts that will be exemplified in the construction set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT THE INVENTION

Figure 1:
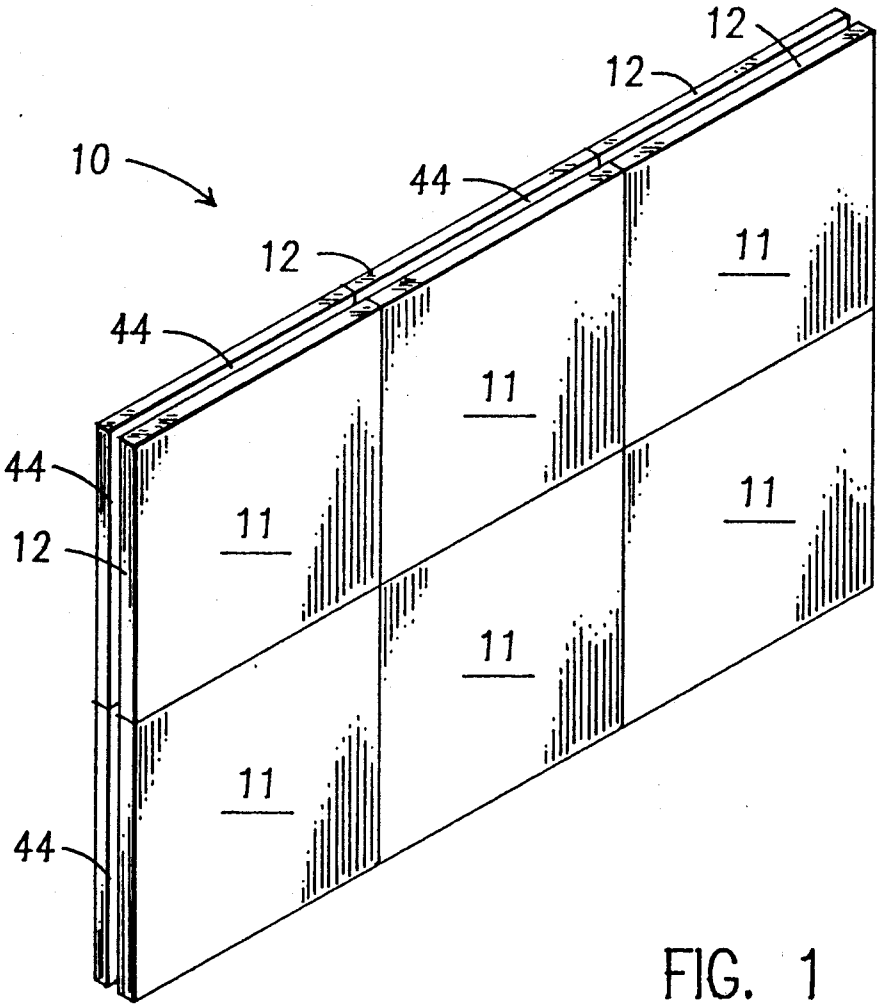
FIG. 1 is a perspective view of a flat display surface made by interlocking a plurality of the novel panels to one another.

Referring now to FIG. 1, it will there be seen that a flat display surface formed by a plurality of the novel interlocked panels 11 is denoted as a whole by the reference numeral 10. The panels can form divider walls for office buildings and may provide numerous other surfaces as well.

Figure 2:
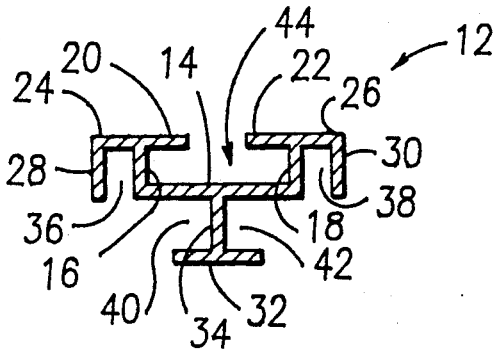
FIG. 2 is a transverse sectional view of the track member of this invention.

A transverse sectional view of the novel track member 12 is provided in FIG. 2. Track member 12 includes bottom wall 14, side walls 16, 18 projecting forwardly from opposite edges thereof, inwardly extending top walls 20, 22, outwardly extending top walls 24, 26, rearwardly extending end walls 28, 30 that depend from the outer ends of outwardly extending top walls 24, 26, respectively, and anchor wall 32 and a rearwardly extending interconnecting wall 34 that interconnects bottom wall 14 to anchor wall 32.

It should be understood from the outset that four track members 12 are placed into a square or rectangular configuration at the beginning of the panel manufacturing process. Massive fixture members, not shown, are disposed in abutting relation to end walls 28, 30 of each track member 12 to thereby form a cavity defined on four edges by the track members 12 and on the sides or faces by the fixtures. An aperture, not shown, is provided in bottom wall 14 of one of the track members 12, and urethane in a semi-liquid state is injected into the square or rectangular planar cavity defined by the track members and the fixtures.

It should therefore be clear that the urethane enters into space 36 (between side wall 16 and end wall 28), space 38 (between side wall 18 and end wall 30), and spaces 40, 42 on opposite sides of interconnecting wall 34. Thus, when the urethane cures and becomes hard, anchor wall 32 will firmly retain track 12 within the edge of its panel. Cavity 44, defined by bottom wall 14, side walls 16, 18 and inwardly extending top walls 20, 22 will remain empty.

Figure 3:
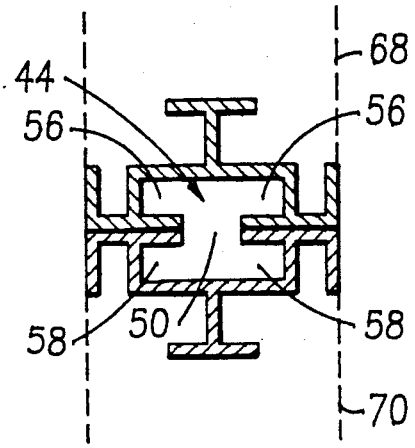
FIG. 3 is a transverse sectional view showing two of the track members of FIG. 2 disposed in abutting relation to one another.

FIG. 3 depicts two track members 12 disposed in abutting relation to one another. It will be noted that the cavities 44 of each track member 12 form a generally "H"-shaped configuration when the track members are so disposed. The collective cavity will also be referred to as cavity 44.

Figure 4:
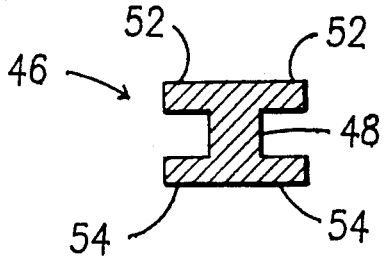
FIG. 4 is a transverse sectional view of a first embodiment of the extrusion member of this invention.

FIG. 4 depicts the extrusion member of the first embodiment of this invention; it is denoted 46 as a whole and has an "H"-shape as shown. Accordingly, it slidably fits within the "H"-shaped cavity 44 of FIG. 3 and locks the abutting track members 12 to one another. Importantly, to unlock the edge-to-edge abutting panel members, extrusion 46 is simply slid out of collective cavity 44. Thus, the assembly and disassembly of adjacent panels both take the same nominal amount of time and effort.

Although no elaboration is needed, it will nonetheless be pointed out that when extrusion member 46 is disposed in interlocking relation to the track members of FIG. 3, cross bar 48 of extrusion 46 slidably fits within the constricted central area 50 of collective cavity 44, and flanges 52, 54 of extrusion 46 slidably fit within the elongated parts of collective cavity 44 which are denoted 56, 58, respectively.

Figure 5:
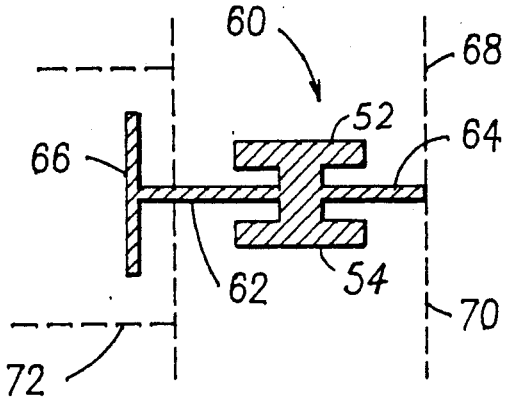
FIG. 5 is a transverse sectional view of a second embodiment of the extrusion member.

Extrusion 60 of FIG. 5 adds branches 62, 64 and arm 66 to extrusion 46 of FIG. 4.

The panel arrangement made possible by this extrusion is shown in phantom lines in FIG. 5. Specifically, panels 68 and 70 are disposed in edge-to-edge relation to one another, and panel 72 is disposed orthogonally to both of them. The track members 12 of each panel are not shown to simplify the Fig., but each track member is as depicted in FIG. 2. The edges of panels 68 and 70 do not abut one another as they do in FIG. 3, because of branches 62 and 64. More precisely, track members 12, 12 of panels 68, 70 respectively, abut one another in FIG. 3 but not in FIG. 5. However, track member 12 of panel 72 does abut the faces of panels 68, 70 as is clearly suggested in FIG. 5.

Figure 6:
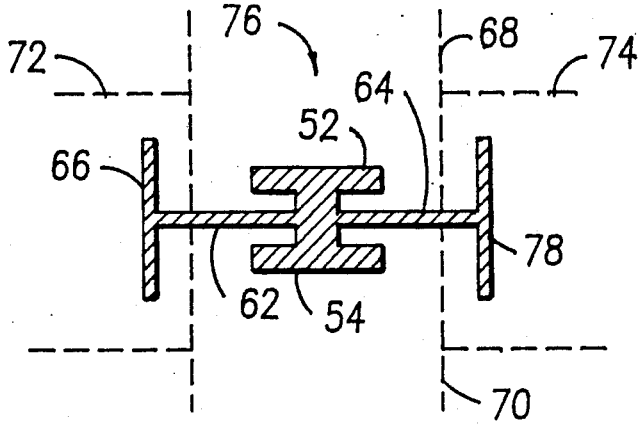
FIG. 6 is a transverse sectional view of a third embodiment of the extrusion member.

FIG. 6 shows an extrusion 76 that adds a second arm 78 to branch 64 and which thereby enables the intersection of panels 68, 70, 72 and 74 as shown. Again, track members 12, 12, 12, 12, of the four intersecting panels 68, 70, 72, 74 which respectively capture arms 52, 54, 66 and 78 in their respective cavities 44 are not shown to simplify the Fig.

Figure 7:
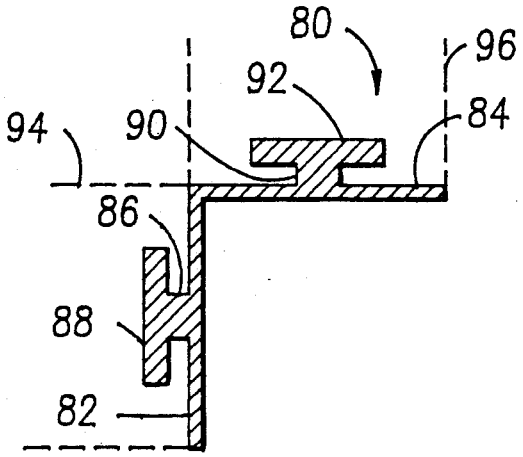
FIG. 7 is a transverse sectional view of a fourth embodiment.

A fourth extrusion 80 is depicted in FIG. 7. It includes walls 82 and 84 which are integral to one another and orthogonally disposed with respect to one another as shown. Branch 86 connects arm 88 to wall 82 and branch 90 connects arm 92 to wall 84. Cavities 44, 44 of track members 12, 12 of panels 94, 96 respectively capture arms 88, 92 to join said panels together in the orthogonal disposition shown.

Figure 8:
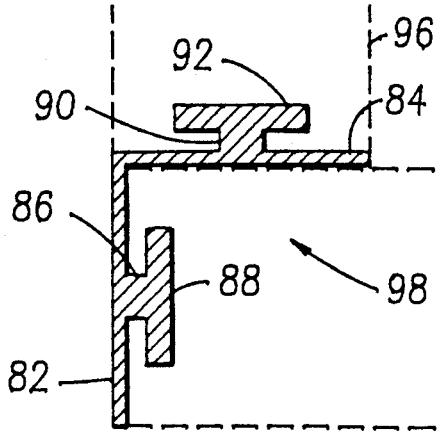
FIG. 8 is a transverse sectional view of a fifth embodiment of the extrusion member.

The extrusion 98 shown in FIG. 8 is a variation of the FIG. 7 extrusion. The same reference numerals used in FIG. 7 are applied to the parts in FIG. 8 because of the similar structure of the FIG. 7 and FIG. 8 extrusions. Panels 94 and 96 are again interlocked in orthogonal relation as depicted, but with perhaps greater structural stability due to the abutting relation therebetween provided by extrusion 98.

Figure 9:
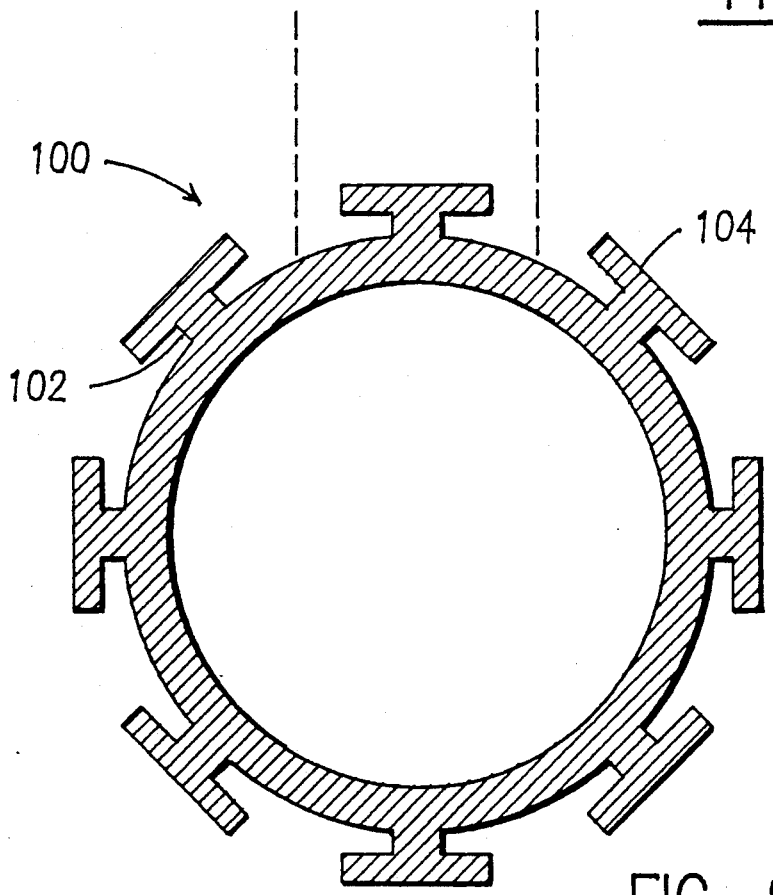
FIG. 9 is a transverse sectional view of a sixth embodiment of the extrusion member.

In view of the numerous embodiments of extrusions disclosed herein, additional embodiments will become apparent to those skilled in the art. It would unduly lengthen this disclosure to expressly disclose all of the additional embodiments and for this reason the additional embodiments are inferentially disclosed by way of example. Extrusions 100 having radial arms 102 and branches 104, such as shown in FIG. 9, to provide a radial display of panels 106, for example, are clearly within the scope of this invention.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also understood that the following claims are intended to cover all of the generic and specific features of the invention herein described, and all statements of the scope of the invention which, as a matter of language, might be said to fall therebetween.

Now that the invention has been described,

What is claimed is:

1. A track member, comprising:

an elongate, flat bottom wall;

a pair of elongate, flat, forwardly extending side walls integral to opposite sides of said bottom wall, said side walls being parallel to one another and being at right angles to said bottom wall;

a pair of elongate, flat, inwardly extending top walls integral to respective distal free ends of said side walls, said inwardly extending top walls extending toward one another in parallelism to said bottom wall and at right angles to said side walls;

a pair of elongate, flat, outwardly extending top walls integral to respective distal free ends of said side walls, said outwardly extending top walls extending away from one another in parallelism to said bottom wall and at right angles to said side walls;

a pair of elongate, flat, rearwardly extending end walls integral to respective distal free ends of said outwardly extending top walls, said end walls extending in parallelism to one another and in parallelism to said side walls;

an elongate, flat interconnecting wall integral to said bottom wall at a mid-point thereof, said interconnecting wall extending rearwardly and at a right angle to said bottom wall, in parallelism to said side and end walls;

an elongate, flat anchor wall integral to said interconnecting wall and disposed at a right angle thereto in parallelism to said bottom wall and said inwardly and outwardly extending top walls; and pl said inwardly and outwardly extending top walls being coplanar with one another.

2. The panel member of claim 1, further comprising an extrusion member having a transverse section that has an "H"-shaped configuration, said extrusion member having a pair of parallel first and second arm members interconnected by a cross bar member, and said extrusion member slidably fitting within a collective "H"-shaped cavity defined by a pair of abutting track members disposed in edge-to-edge relation to one another.

3. The panel member of claim 2, wherein said extrusion member further comprises a first branch member integral to said cross bar member and projecting orthogonally therefrom in parallelism to said first and second parallel arm members and a third arm member integral to said first branch member at a distal end thereof, said third arm member being disposed orthogonally to said first branch member, so that a cavity means of a third track member slidably engages said third arm member and is thereby interlocked to said pair of abutting track members disposed in edge-to-edge relation to one another, said third track member being orthogonal to said pair of abutting track members when so interlocked.

4. The panel member of claim 3, wherein said extrusion member further comprises a second branch member integral to said cross bar member and projecting orthogonally therefrom in parallelism to said first and second parallel arm members, said second branch member extending from said cross bar member in a direction opposite to the direction of said first branch member, and a fourth arm member integral to said second branch member at a distal end thereof, said fourth arm member being disposed orthogonally to said second branch member, so that a cavity means of a fourth track member slidably receives said fourth arm member and is thereby interlocked to said first, second and third track members, said fourth track member being disposed orthogonal to said first and second track members and extending therefrom in a direction opposite from said third track member when so interlocked.

5. The panel member of claim 1, further comprising an extrusion member having a transverse section that includes a flat wall member bent at a right angle mid-length thereof to form first and second wall members having a common breadth, a first branch member integral to said first wall and projecting orthogonally from a mid-point thereof, a second branch member integral to said second wall and projecting orthogonally from a mid-point thereof, said first and second branch members extending outwardly relative to an included angle defined by said first and second wall members, a first arm member integral to said first branch member at a distal end thereof, said first arm member being disposed orthogonal to said first branch member, in parallelism with said first wall member, and a second arm member integral to said second branch member at a distal end thereof, said second arm member being disposed orthogonal to said second branch member, in parallelism with said second wall member;

whereby a cavity means of a first track member slidably receives said first branch and arm members and a cavity means of a second track member slidably receives said second branch and arm members so that said first and second track members are interlocked to one another and form a right angle with respect to one another.

6. The panel member of claim 1, further comprising an extrusion member having a transverse section that includes a flat wall member bent at a right angle mid-length thereof to form first and second wall members having a common breadth, a first branch member integral to said first wall and projecting orthogonally from a mid-point thereof, a second branch member integral to said second wall and projecting orthogonally from a mid-point thereof, said first branch member extending outwardly relative to an included angle defined by said first and second wall members, said second branch member extending inwardly relative to an included angle defined by said first and second wall members, a first arm member integral to said first branch member at a distal end thereof, said first arm member being disposed orthogonally to said first branch member, in parallelism with said first wall member, and a second arm member integral to said second branch member at a distal end thereof, said second arm member being disposed orthogonal to said second branch member, in parallelism with said second wall member;

whereby a cavity means of a first track member slidably receives said first branch and arm members and a cavity means of a second track member slidably receives said second branch and arm members so that said first and second track members are interlocked to one another and form a right angle with respect to one another.

7. The panel member of claim 4, further comprising an extrusion member having a transverse section that includes an annular base member having radially disposed branch members integral therewith that project outwardly therefrom, and that further includes a wall member integral to a distal free end of each branch member, each of said wall members being orthogonally disposed in relation to its associated branch member;

whereby a plurality of radially disposed track members are releasably secured to said extrusion member.

* * * * *